United States Patent [19]

Hundertmark

[11] Patent Number: 4,674,449

[45] Date of Patent: Jun. 23, 1987

[54] PRESSURE REGULATED COOLING SYSTEM

[75] Inventor: James M. Hundertmark, Fond du Lac, Wis.

[73] Assignee: Brunswick Corporation, Skokie, Ill.

[21] Appl. No.: 811,795

[22] Filed: Dec. 20, 1985

[51] Int. Cl.[4] ..... F01P 7/14

[52] U.S. Cl. ..... 123/41.08

[58] Field of Search ..... 123/41.02, 41.08, 41.09; 137/115

[56] References Cited

U.S. PATENT DOCUMENTS

| | | | |
|---|---|---|---|
| 3,918,418 | 11/1975 | Horn | 123/41.08 |
| 3,939,807 | 2/1976 | Eichinger | 123/41.08 |
| 4,082,068 | 4/1978 | Hale | 123/41.02 |
| 4,140,089 | 2/1979 | Kueny | 123/41.08 |
| 4,312,304 | 1/1982 | Tyner | 123/41.31 |
| 4,357,912 | 11/1982 | Brown | 123/41.08 |

*Primary Examiner*—William A. Cuchinski, Jr.

*Attorney, Agent, or Firm*—O. T. Sessions

[57] ABSTRACT

A cooling system for the engine (11) of an outboard motor (10) uses a pressure relief valve (28) to control the coolant pressure and flow through the cylinder block (34). The relief valve member (36) controls flow at the outlet (42) of the block and is controlled by a diaphragm (45) responding to pump (14) discharge pressure at the inlet to the block (34). An orifice (53) bypasses flow around the block (34) when the main valve seat (35) is closed and is closed by the valve member (36) when the main valve seat (35) is fully opened.

7 Claims, 3 Drawing Figures

PRESSURE REGULATED COOLING SYSTEM

DESCRIPTION

1. Technical Field

This invention relates to cooling systems for internal combustion engines and more particularly to cooling systems for marine propulsion systems such as outboard motors driven by internal combustion engines.

2. Background Art

Outboard motors are generally water cooled with the cooling water pumped directly from and returned to the body of water in which the motor is operating. Most outboard motors use two cycle engines with the fuel and air intake passing through a pressurized crankcase system. As a result portions of the fuel and oil tend to condense on the inside of the engine parts and cylinders collecting in low spots, particularly when the engine is run at low speeds. Various cooling systems have been suggested for maintaining a relatively high engine temperature during idle and low speed operation to alleviate the problem of condensed fuel, while operating at substantially lower temperatures at high speeds where the effects of condensing fuel are essentially negligible. One such system is disclosed in U.S. Pat. No. 4,082,068 to Hale. The Hale cooling system utilizes a thermostatic valve to maintain engine temperature at low speeds and a pressure relief valve to allow substantially higher cooling flow rates at higher speeds to reduce the engine temperature. U.S. Pat. No. 3,918,418 to Horn discloses a pressure relief valve suitable for use in a system like that disclosed by Hale.

Another cooling system suitable for outboard motors is disclosed in U.S. Pat. No. 4,140,089 to Kueny et al. Yet another cooling system is disclosed in U.S. Pat. No. 4,357,912 to Brown.

DISCLOSURE OF INVENTION

One object of the present invention is to provide a cooling system for an outboard motor requiring lower coolant pressures than prior systems.

Another object of the invention is to provide a cooling system which eliminates the oscillations in pressure of the coolant which have occurred in prior systems.

To accomplish the foregoing objectives, the present invention provides an internal combustion engine for a marine propulsion device including a cooling jacket having an inlet and an outlet. A pump having an output correlated to engine speed provides coolant to the inlet of the cooling jacket. A main valve seat at the outlet of the cooling jacket provides communication between the cooling jacket and a discharge passage. A pressure relief valve member is resiliently biased towards a position closing the valve seat. The valve member is operated by a fluid pressure responsive operator means coupled to the valve member to open the valve member in response to the pressure at the inlet to the cooling jacket.

Preferably the pressure responsive operator means includes a chamber connected directly to the outlet of the pump with a diaphragm coupled to the valve member, mounted in the chamber, and having one side subject to the outlet pressure from the pump.

The operator means can include an orifice between the operator chamber and the discharge passage to allow a limited flow of coolant from the chamber to the discharge passage, bypassing the cooling jacket.

In the preferred embodiment, the valve member includes a valve stem connected to the diaphragm, with the valve stem passing through the orifice between the operator chamber and the discharge passage.

The engine of the invention can also include a valve seat on the orifice facing the valve member. The valve member can act to close the orifice valve seat as the main valve seat is open.

BEST MODE FOR CARRYING OUT THE INVENTION

Figure 2:
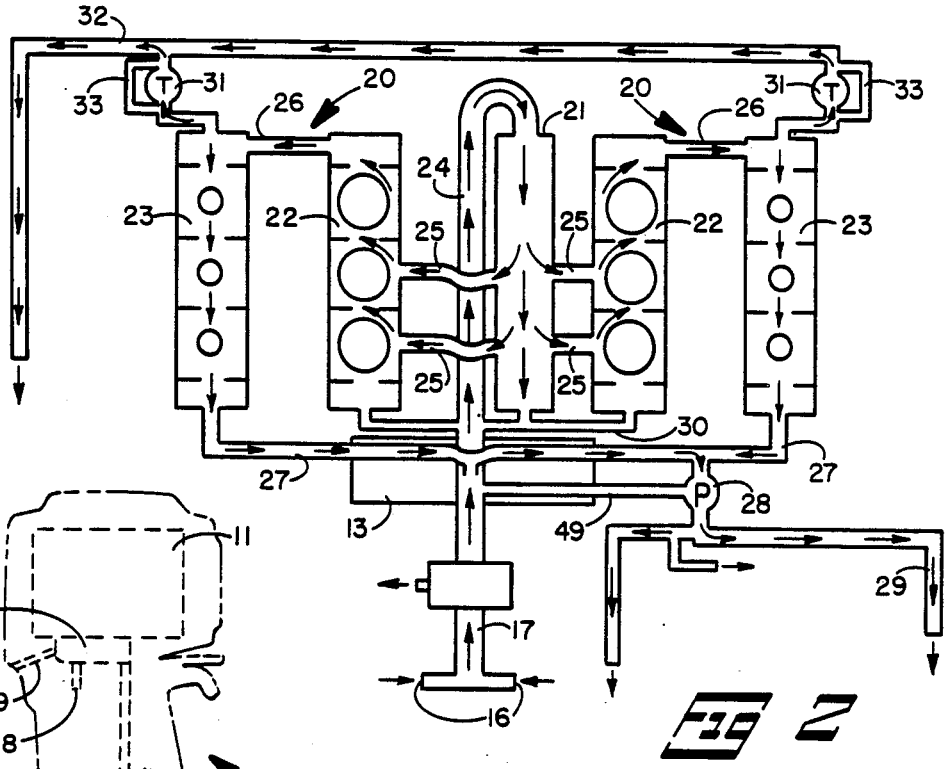
FIG. 2 is a schematic drawing of the cooling system of an outboard motor in accordance with the invention.
Figure 1:
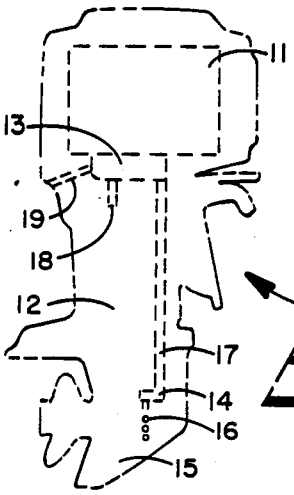
FIG. 1 is a schematic drawing of an outboard motor showing its basic features.

Referring to the drawings, an outboard motor 10 is shown having an internal combustion engine 11 mounted in its upper portion. The engine 11 is supported above the drive shaft housing 12 by adapter plates 13 which serve to provide the required exhaust and water passages. A water pump 14 driven by the engine's drive shaft, not illustrated, is mounted in the lower unit 15 and is connected to water inlets 16. A water passage 17 from the pump outlet to the adapter plates 13 provides flow from the water pump 14 through the engine 11. Water from the engine 11 is discharged through passage 18 into exhaust passages, not illustrated, in the drive shaft housing 12 to cool the exhaust. In addition a tell-tale water discharge passage 19 is provided at the aft of the outboard motor 10 to give a visual indication to the operator that the water pump 14 is operating.

Turning to FIG. 2, a water system in accord with the invention is schematically illustrated. The water system is illustrated for a six cylinder engine having two banks of cylinders 20 generally arranged in a V. The engine 11 includes a water jacket 21 covering the engine's exhaust manifold, two cylinder block water jackets 22, one for each bank of cylinders 20, and water jackets 23 covering the cylinder heads of each bank 20.

An engine driven pump 14 uses a flexible impeller, not illustrated, in conventional fashion to draw water in inlets 16 of the lower unit 15 of the outboard motor 10. The pump 14 functions essentially as a positive displacement pump, with its output proportional to its speed.

Water discharged from the pump 14 is supplied by passages 17 and 24 to the upper portion of the exhaust manifold water jacket 21. From the exhaust manifold jacket 21, the water is dispersed through passages 25 to the cylinder block jackets 22. Passages 26 connecting the top of the cylinder block jackets 22 with their corresponding cylinder head jackets 23 supply cooling water to the top of the cylinder head jackets 23. The bottoms of the cylinder head jackets 23 are connected by a discharge passage 27 to a pressure relief valve 28 at the bottom of the engine 11. From the pressure relief valve 28, water is discharged by separate lines into the engine exhaust 18, to the tell-tale 19 and to a main water discharge passage 29. Drain passages 30 at the bottom of the cylinder block jackets 22 and exhaust manifold jacket 21 connect to the inlet passage 24 and allow water to drain from the engine 11 when not in use.

Thermostatic valves 31 at the top of each cylinder bank 20 are connected by a discharge line 32 to the tell-tale 19 at the rear of the outboard motor 10. Vent holes 33 in each thermostatic valve 31 prevent the entrapment of air or other gases at the top of the water jackets 22 and 23.

Figure 3:
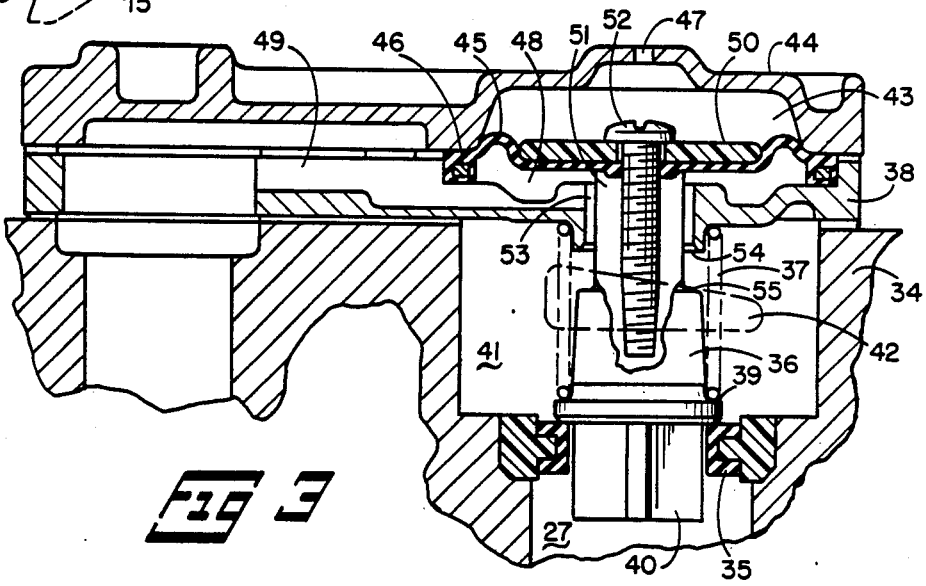
FIG. 3 is a sectional view of a pressure relief valve used in the cooling system of the invention.

The pressure relief valve 28, as shown in detail in FIG. 3, is housed in the lower portion of the cylinder block 34 and includes a main valve seat 35 provided in the cylinder block 34. A valve member 36 is resiliently biased by a coil spring 37 to normally close the main valve seat 35. The spring 37 is compressed between a valve plate 38 attached to the cylinder block 34 and an annular rim 39 formed around the valve member 36. A cruciform guide member 40 formed integrally with the valve member 36 protrudes through the main valve seat 35 to keep the valve member 36 aligned with the main valve seat 35. Opening the valve member 36 allows coolant flow from the discharge pasage 27 in the cylinder block 34 through the main valve seat 35 into a discharge chamber 41 formed between the block 34 and the valve plate 38 and thence out through the outlet port 42.

An operator chamber 43 is formed between the valve plate 38 and valve cover 44 to house a diaphragm 45 to operate the valve member 36. The diaphragm 45 has its annular rim 46 compressed between the valve plate 38 and the valve cover 44 to support the diaphragm 45 in the operator chamber 43. A vent 47 is provided in the valve cover 44 to allow free operation of the diaphragm 45 and valve member 36 in response to water pressure in the working chamber 48. The working chamber 48 is connected directly to the outlet of the water pump 14 by a passage 49 which bypasses the flow around the main cooling passages in the cylinder block 34.

The central portion of the diaphragm 45 is clamped between a metal piston 50 and the valve stem 51 by a screw 52 to firmly attach the diaphragm 45 to the valve stem 51. The valve stem 51 extends through a hole 53 in the valve plate 38, with the clearance between the valve stem 51 and hole 53 forming an orifice which allows a restricted flow from the working chamber 48 to the discharge chamber 41.

An orifice valve seat 54 is formed on the valve plate 38 surrounding the hole 53 and faces into the discharge chamber 41. This orifice valve seat 54 acts with the outward portion 55 of the valve member 36 to close the orifice when the main valve formed by the main valve seat 35 and valve member 36 is fully opened.

OPERATION

In operation the engine 11 drives the water pump 14 to produce a coolant flow approximately proportional to the engine speed. When the engine 11 is started, the cylinder block 34 will be relatively cool and the thermostatic valves 31 will be closed. While the engine 11 is still operating at low speed the main pressure relief valve will also be closed by the valve member 36. The orifice surrounding the valve stem 51 will be open and is sized to accommodate the full outlet of the pump 14 at idle speeds. Thus while the engine 11 is idling and cool the full output of the pump 14 will bypass the engine's cooling jackets 21, 22, and 23 and be discharged through the orifice hole 53 and out the outlet port 42. During low speed operation the orifice 53 prevents a build up of pressure in the operator chamber 43 which would cause the diaphragm 45 to open the main valve member 36.

As the engine warms up the thermostatic valves 31 will open to maintain the temperature at the top of the cylinder block 34 at a pre-selected temperature, preferably about 140° F. The thermostatic valves 31 will thus allow flow through the cylinder block jackets 22 while flow through the cylinder head jackets 23 is prevented. This allows a higher temperature to be maintained at the cylinder heads to improve combustion efficiency.

As the engine speed is increased, the output from the water pump 14 will increase producing an increased flow through the operator chamber 48 and orifice 53. As the flow increases, the pressure in the operator chamber 48 will necessarily increase until the pressure on the diaphragm 45 produces a force on the valve stem 51 matching the force produced by the coil spring 37. At this point, the pressure relief valve member 36 will begin to open. As the pressure relief valve opens, more of the flow will pass through the main valve seat 35 and out the outlet port 42, until the forces produced by the diaphragm 45 and spring 37 are again balanced.

As the engine speed continues to increase, the valve member 36 will open further until it contacts the orifice valve seat 54. At this point the flow through the orifice 54 will be cut off and the entire output of the water pump 14 will pass through the main valve seat 35.

Once the main valve seat 35 has been opened by the valve member 36, substantial flow will begin to take place through the cylinder block and cylinder head jackets 22 and 23 to substantially reduce the temperature of the cylinder block 34 allowing the thermostatic valves 31 to close. Thus at higher speeds the engine 11 will operate at a lower temperature to provide increased thermodynamic efficiency.

What is claimed is:

1. An internal combustion engine for a marine propulsion device, said engine comprising:
   (A) a cooling jacket means having an inlet and an outlet;
   (B) a pump for providing coolant to the inlet of said cooling jacket means, said pump having an output correlating to engine speed;
   (C) a main valve seat at said outlet for providing communication between said cooling jacket and a discharge passage;
   (D) a pressure relief valve member seated on said valve seat and resiliently biased to a closed position;
   (E) a fluid pressure responsive operator means coupled to said valve member to open said valve member in response to the pressure at said inlet, said operator means including a chamber connected directly to the outlet of said pump and a diaphragm in said chamber coupled to said valve member, said diaphragm having one side subject to the outlet pressure from said pump, and an orifice between said chamber and said discharge passage to allow a limited flow of coolant from said chamber to said discharge passage.

2. The engine defined in claim 1 wherein said valve member includes a valve stem connected to said diaphragm, said valve stem passing through said orifice.

3. The engine defined in claim 2 further comprising a spring to bias said valve member to a closed position.

4. The engine defined in claim 2 wherein said orifice includes a valve seat facing said valve member and said valve member acts to close said orifice valve seat as said main valve seat is opened.

5. The engine defined in claim 1 further comprising a thermostatic valve means connected to said cooling jacket to permit flow through said cooling jacket and said thermostatic valve means in response to the temperature of the coolant in said jacket.

6. The engine defined in claim 5 wherein said cooling jacket includes a cylinder jacket and a cylinder head jacket connected at their upper ends, with said thermostatic valve means located at the upper end of one of said cylinder jacket and said head jacket.

7. The engine defined in claim 6 wherein said main valve seat is connected to the bottom of said cylinder head jacket.

* * * * *